US010218125B2

(12) United States Patent
Qiu et al.

(10) Patent No.: US 10,218,125 B2
(45) Date of Patent: Feb. 26, 2019

(54) ELECTRICAL CONNECTOR HAVING INTERLOCKED SHELL AND HOUSING PORTIONS AND STACKED GROUNDING TERMINALS

(71) Applicant: FOXCONN INTERCONNECT TECHNOLOGY LIMITED, Grand Cayman (KY)

(72) Inventors: Jin-Guo Qiu, Huaian (CN); Jun Zhao, Huaian (CN); Wei Wen, Huaian (CN)

(73) Assignee: FOXCONN INTERCONNECT TECHNOLOGY LIMITED, Grand Cayman (KY)

( * ) Notice: Subject to any disclaimer, the term of this patent is extended or adjusted under 35 U.S.C. 154(b) by 0 days.

(21) Appl. No.: 15/629,771

(22) Filed: Jun. 22, 2017

(65) Prior Publication Data

US 2017/0373438 A1 Dec. 28, 2017

(30) Foreign Application Priority Data

Jun. 22, 2016 (CN) ..... 2016 1 0455661

(51) Int. Cl.
*H01R 13/648* (2006.01)
*H01R 13/6581* (2011.01)
(Continued)

(52) U.S. Cl.
CPC ..... *H01R 13/6581* (2013.01); *H01R 13/405* (2013.01); *H01R 13/506* (2013.01);
(Continued)

(58) Field of Classification Search
CPC ..... H01R 23/688; H01R 23/6873; H01R 23/7073
(Continued)

(56) References Cited

U.S. PATENT DOCUMENTS 8,573,995 B2 11/2013 Golko
8,814,443 B2 * 8/2014 He ..... G02B 6/3817 385/49
9,022,800 B2 * 5/2015 Yang ..... H01R 13/6581 439/487
9,214,766 B1 * 12/2015 Yu ..... H01R 13/6585
(Continued)

FOREIGN PATENT DOCUMENTS

CN 204118317 1/2015
CN 204118373 U 1/2015
(Continued)

*Primary Examiner* — Thanh Tam Le
(74) *Attorney, Agent, or Firm* — Wei Te Chung; Ming Chieh Chang

(57) ABSTRACT

An electrical connector includes: a contact module comprising an insulative housing having a base portion and a tongue portion, and a number of conductive terminals affixed to the insulative housing and each comprising a contacting portion exposed to a surface of the tongue portion, a soldering portion and a connecting portion connecting the contacting portion and the soldering portion; and a metal shell comprising a pair of locking grooves depressed forwardly from a rear surface thereof; wherein the insulative housing comprises a pair of mounting portions located at two lateral sides of a rear end thereof, the mounting portions are stuck in the locking grooves when the contact module is assembled to the metal shell along a rear-to-front direction, and a lower portion of each mounting portion is resisted against the rear surface of the metal shell.

16 Claims, 10 Drawing Sheets

(51) Int. Cl.

| | |
|---|---|
| ***H01R 13/405*** | (2006.01) |
| ***H01R 13/506*** | (2006.01) |
| ***H01R 13/52*** | (2006.01) |
| ***H01R 13/64*** | (2006.01) |
| *H01R 24/60* | (2011.01) |
| *H01R 107/00* | (2006.01) |

(52) U.S. Cl.
CPC ..... *H01R 13/5202* (2013.01); *H01R 13/64* (2013.01); *H01R 24/60* (2013.01); *H01R 2107/00* (2013.01)

(58) Field of Classification Search
USPC ..... 439/607.05, 607.09, 607.1, 607.13, 439/607.23, 607.32, 607.35, 660
See application file for complete search history.

(56) References Cited

U.S. PATENT DOCUMENTS

| | | | | |
|---|---|---|---|---|
| 9,281,626 | B2 * | 3/2016 | Lin | H01R 13/6581 |
| 9,502,821 | B2 * | 11/2016 | Little | H01R 13/6582 |
| 9,590,347 | B2 | 5/2017 | Zhao | |
| 9,692,166 | B2 * | 6/2017 | Kao | H01R 13/42 |
| 9,742,098 | B2 * | 8/2017 | Zhao | H01R 13/5202 |
| 2015/0244099 | A1 | 8/2015 | Lee | |
| 2016/0104957 | A1 | 4/2016 | Kim | |

FOREIGN PATENT DOCUMENTS

| | | |
|---|---|---|
| CN | 204243365 | 4/2015 |
| CN | 204315771 | 5/2015 |
| CN | 105024197 | 11/2015 |
| CN | 105024197 A | 11/2015 |

* cited by examiner

ELECTRICAL CONNECTOR HAVING INTERLOCKED SHELL AND HOUSING PORTIONS AND STACKED GROUNDING TERMINALS

BACKGROUND OF THE DISCLOSURE

1. Field of the Disclosure

The present disclosure relates to an electrical connector adapted for normally and reversely mating. This application relates to the copending application with the same inventors, the same applicant, the same filing date with a title of "ELECTRICAL CONNECTOR HAVING GROUNDING TERMINALS SERVING A LATCHING FUNCTION".

2. Description of Related Arts

China Patent No. 204315771 discloses a reversible or dual orientation USB Type-C connector comprising a contact module having an upper insulator affixing with a row of upper terminals, a lower insulator affixing with a row of lower terminals, a metal plate sandwiched between the upper insulator and the lower insulator, and a covering insulator over molded with the upper insulator and the lower insulator. The contact module is received in a metal shell. When the contact module is received in the metal shell, since there is no interference fit therebetween, insufficient molding may result, which disadvantages automated production. U.S. Pat. No. 8,573,995 discloses a ground ring that may be fabricated using, for example, a metal injection molding (MIM) process.

An improved electrical connector is desired.

SUMMARY OF THE DISCLOSURE

Accordingly, an object of the present disclosure is to provide an electrical connector contributing to automated production.

To achieve the above object, an electrical connector comprises: a contact module comprising an insulative housing having a base portion and a tongue portion, and a plurality of conductive terminals affixed to the insulative housing and each comprising a contacting portion exposed to a surface of the tongue portion, a soldering portion and a connecting portion connecting the contacting portion and the soldering portion; and a metal shell comprising a pair of locking grooves depressed forwardly from a rear surface thereof; wherein the insulative housing comprises a pair of mounting portions located at two lateral sides of a rear end thereof, the mounting portions are stuck in the locking grooves when the contact module is assembled to the metal shell along a rear-to-front direction, and a lower portion of each mounting portion is resisted against the rear surface of the metal shell.

Other objects, advantages and novel features of the disclosure will become more apparent from the following detailed description when taken in conjunction with the accompanying drawings.

DETAILED DESCRIPTION OF THE PREFERRED EMBODIMENT

Figure 1:
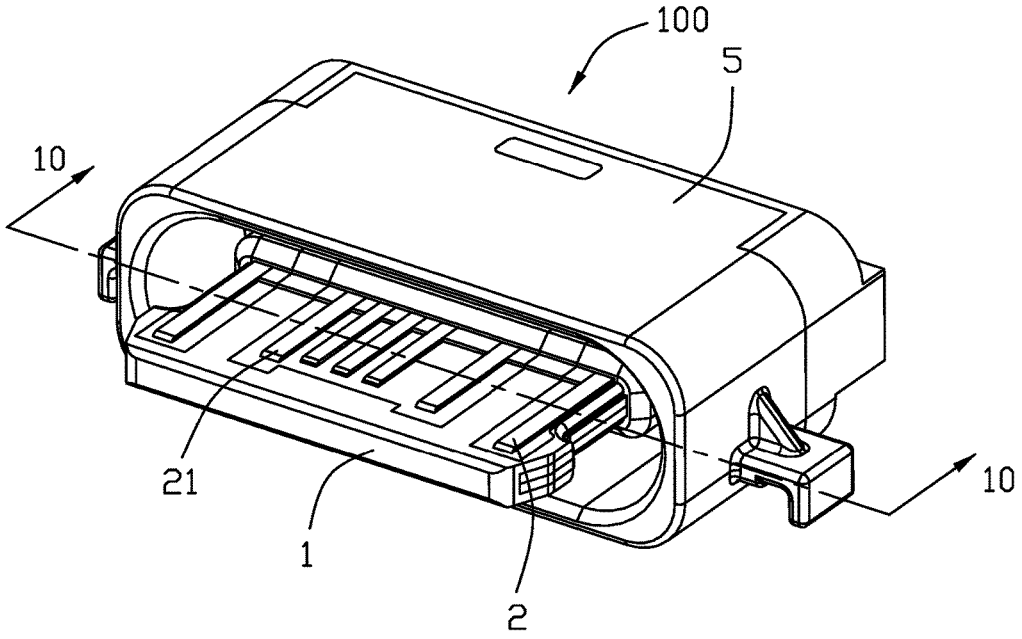
FIG. 1 is a perspective, assembled view of an electrical connector.
Figure 2:
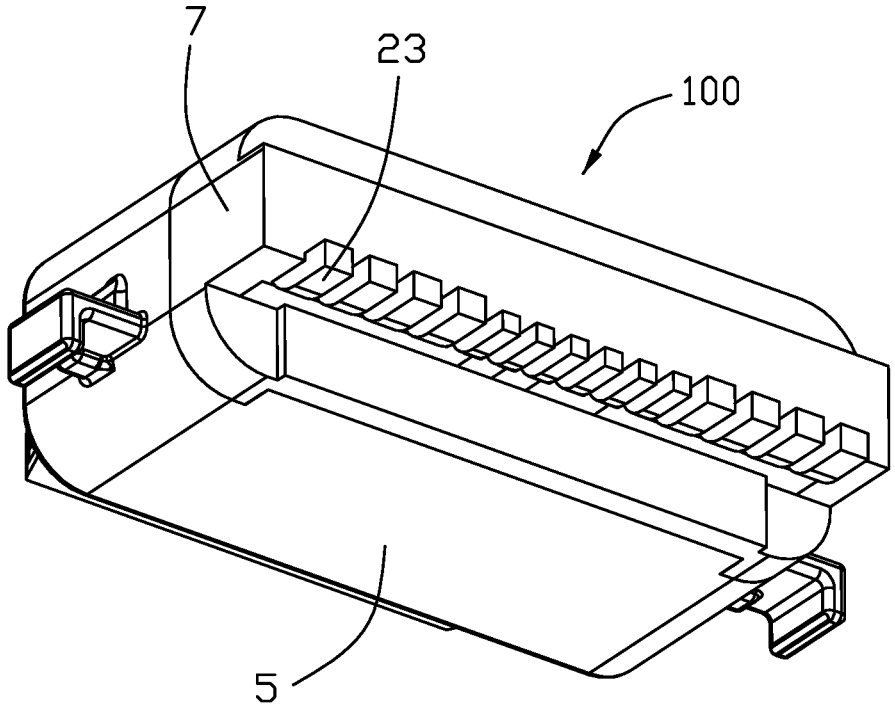
FIG. 2 is another perspective, assembled view of the electrical connector taken from FIG. 1.
Figure 3:
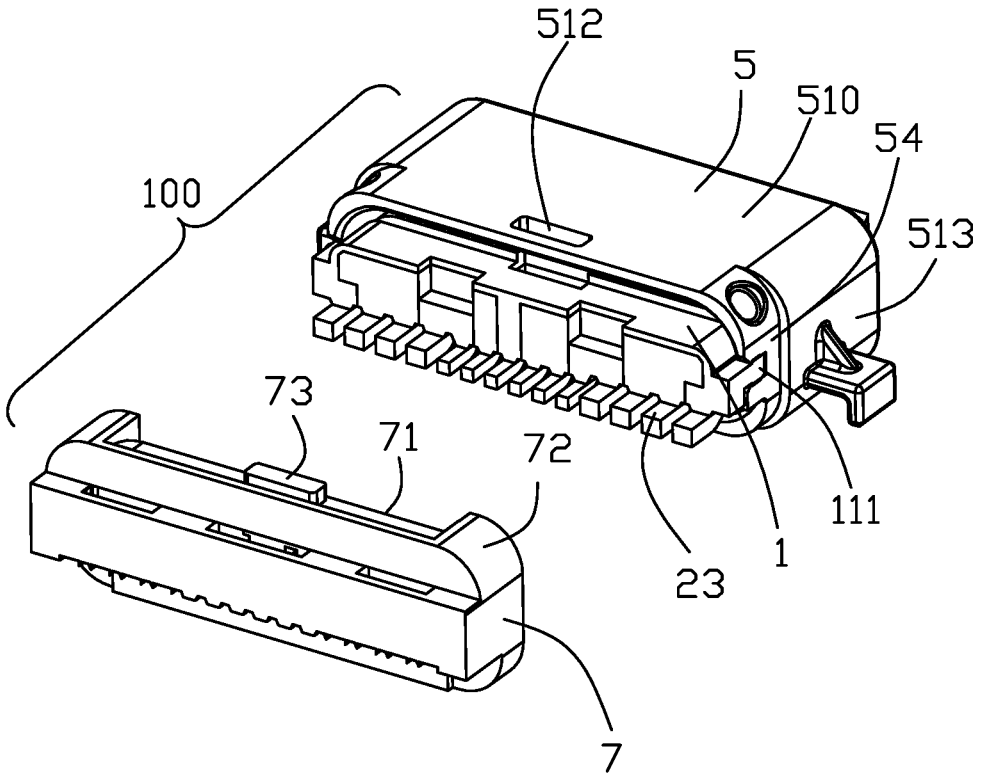
FIG. 3 is an exploded view of the electrical connector not matching with a sealer.
Figure 4:
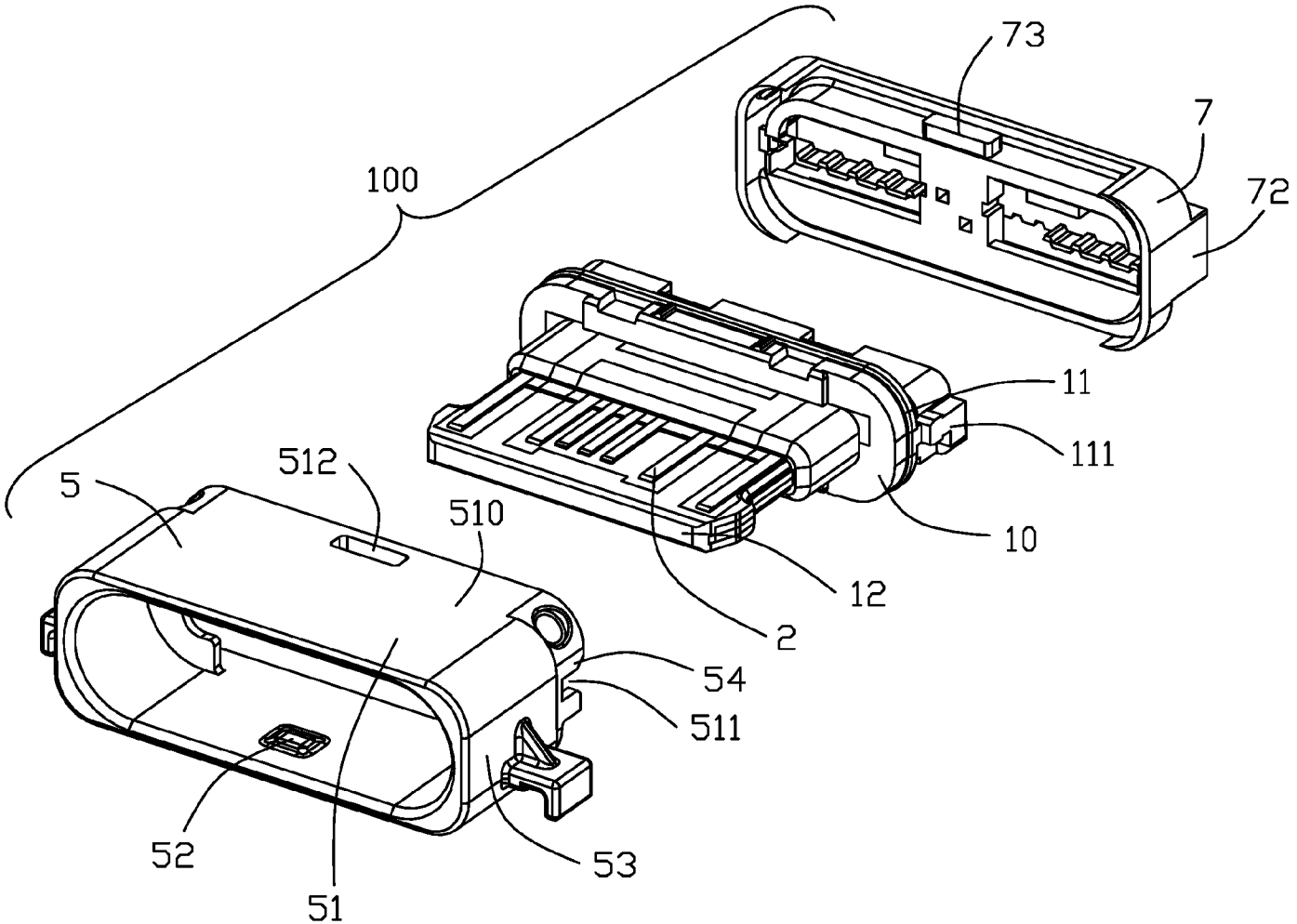
FIG. 4 is a partial exploded view of the electrical connector.
Figure 5:
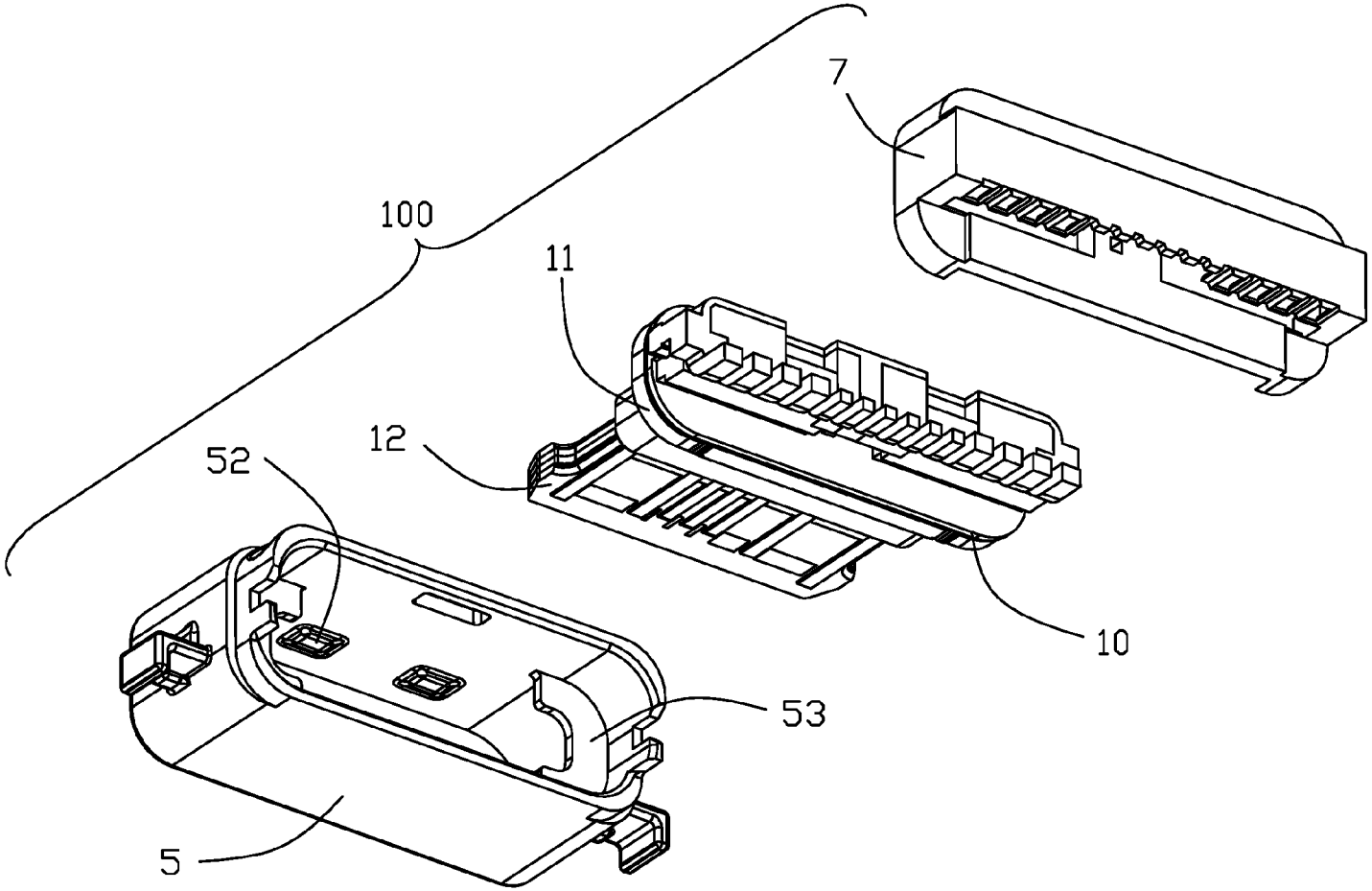
FIG. 5 is another partial exploded view of the electrical connector taken from FIG. 4.
Figure 6:
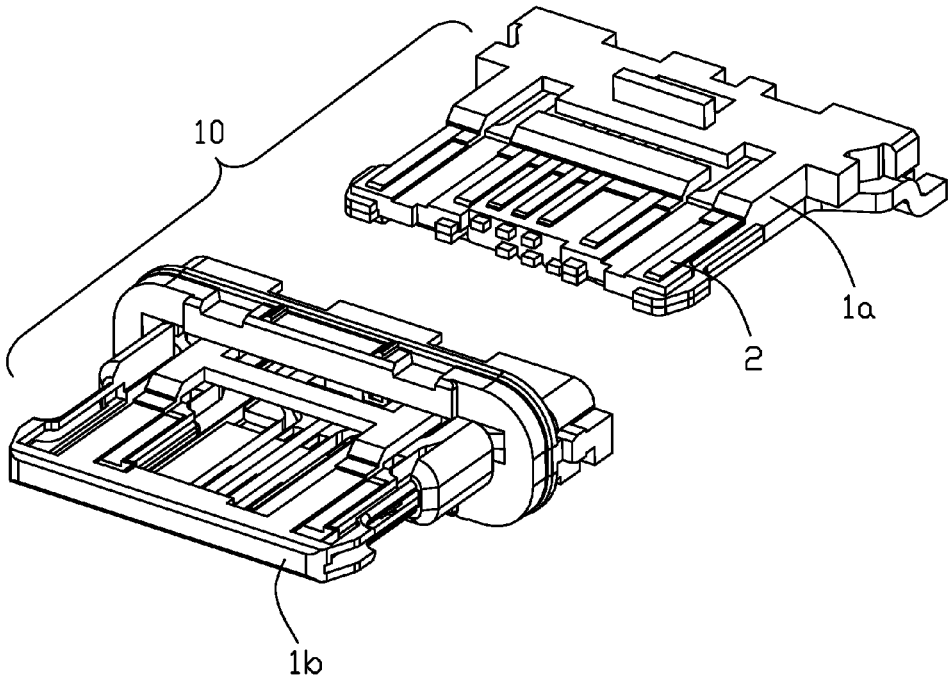
FIG. 6 is a partial exploded view of a contact module of the electrical connector.
Figure 7:
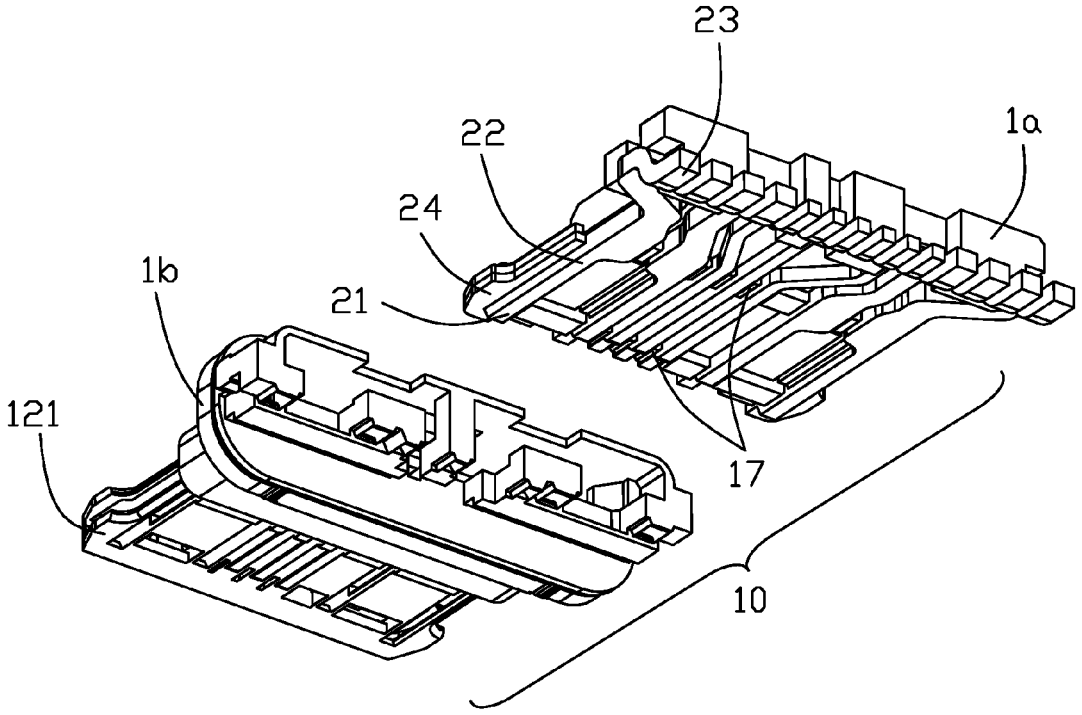
FIG. 7 is another partial exploded view of the contact module taken from FIG. 6.
Figure 8:
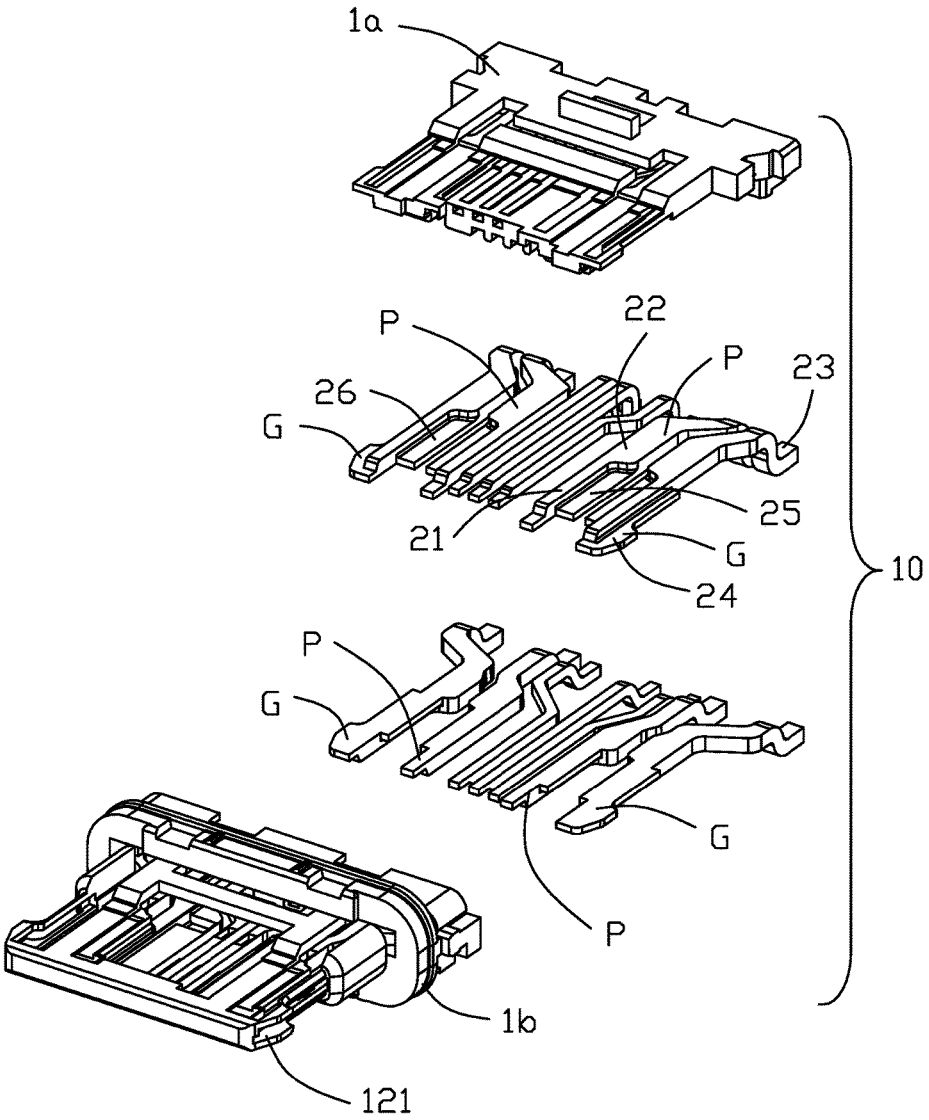
FIG. 8 is an exploded view of the contact module of the electrical connector.
Figure 9:
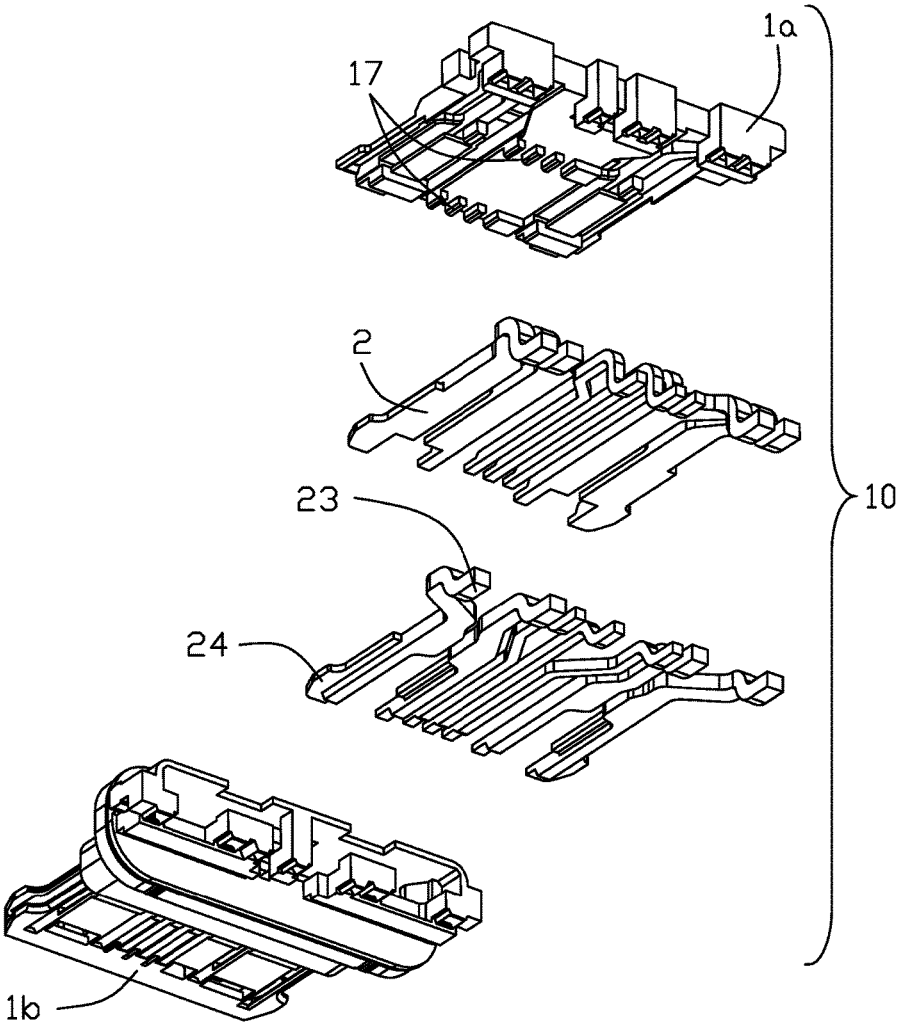
FIG. 9 is another exploded view of the contact module taken from FIG. 8.

Reference will now be made in detail to the embodiments of the present disclosure. The insertion direction is a front-to-rear direction.

Referring to FIGS. 1 to 10, an electrical connector 100 includes a contact module 10, a metal shell 5 enclosing the contact module 10 and a sealer 7 formed of glue.

The contact module 10 includes an insulative housing 1 having a base portion 11 and a tongue portion 12 extending forwardly from the base portion 11, and a number of conductive terminals 2 affixed to the insulative housing 1 and arranged in symmetry in two rows.

The insulative housing 1 includes a first/outer insulator 1*a* and a second/inner insulator 1*b* over molded with the first insulator 1*a*. The base portion 11 is formed by a rear end of the first insulator 1*a* and a rear end of the second insulator 1*b*. The base portion 11 includes a mounting portion 111 in a rear end shaped as "L" thereof. The tongue portion 12 is formed by a front end of the first insulator 1*a* and a front end of the second insulator 1*b*. The second insulator 1*b* includes a pair of protruding portions 121.

The conductive terminals 2 include two grounding terminals G laterally, and a number of power terminals P and signal terminals S located between the two grounding terminals G Each terminal 2 includes a contacting portion 21 exposed to a surface of the tongue portion 12, a soldering portion 23 soldered to a printed circuit board, and a connecting portion 22 connecting the contacting portion 21 and the soldering portion 23. Each grounding terminal G includes a buckling portion 24 bucked with a mated electrical connector, and a second widening portion 26 thinner than other parts of the grounding terminals G The buckling portion 24 extends forwardly to a front end of the contacting portion 21 and extends rearward to the connecting portion 22. The second widening portion 26 is embedded in the tongue portion 12 and extends inward from the contacting portion 21. Each power terminal P includes a first widening portion 25 extending laterally from the contacting portion 21.

The metal shell 5 includes a main portion 51 showed as a cylindrical shape, and a number of grounding portions 52 protruding inward from the main portion 51. The main portion 51 includes a top wall 510, a pair of lateral walls 513 located at two sides of the top wall 510, and a pair of locking grooves 511 each penetrating a rear edge of the metal shell 5. The top wall 510 includes a through hole 512. The lateral walls 513 include a pair of maintaining grooves 54 communicating the locking grooves 511. A lower portion of each mounting portion 511 is resisted against a rear surface of the metal shell 5.

The sealer 7 includes a pair of lateral fixing portions 72, an upper fixing portion 71 located between the pair of the lateral portions 72, and a tuber 73 protruding upwardly.

Referring to FIGS. 1 to 10, the method of making the electrical connector 100 includes the following steps. In a first step, the two rows of conductive terminals 2 are stamped stainless including the ground terminals G The buckling portion 24 is formed by thinning the front end of the ground terminal G, and the untouched portion forms its contacting portion 21. The second widening portion 26 is formed by thinning the front end of the ground terminal G, and the untouched portion forms its contacting portion 21. The first widening portion 25 is formed by thinning the front end of the power terminal P, and the untouched portion forms its contacting portion 21.

In a second step, the first insulator 1*a* affixing with the upper terminals is formed by insert molding. The buckling portions 24 of the grounding terminals G extend laterally from the first insulator 1*a*. The lower terminals abut the first insulator 1*a*. The ground terminal G of the upper terminals 2 and the ground terminal G corresponding to the lower terminals 2 are stacked in a vertical direction. The insulative housing 1 is formed by insert molding the insulative materials with the first insulator 1*a* while the insulative materials form the second insulator 1*b* including the pair of mounting portions 111. The protruding portions 121 are insert molding with the buckling portions 24 to be an integrated mated with the mated electrical connector. The bottom surface of the contacting portion 21 of the ground terminal G near the center of the thickness of the tongue portion 12 is coplanar with the bottom surface of the buckling portion 24 near the center of the thickness of the tongue portion 12. The buckling portion 24 of the ground terminal G extends in the tongue portion 12 making the top surface of the buckling portion 24 far away from the center of the thickness of the tongue portion 12 lower than the top surface of the contacting portion 21 away from the center of the thickness of the tongue portion 12. The thickness of the contacting portions 21 of the power terminals P is equal to that of the contacting portion 21 of the grounding terminals G The thickness of the contacting portions 21 of the power terminals P is greater than that of the contacting portion 21 of the signal terminals. The addition of the thickness of the grounding terminal of the upper terminals 2 and the grounding terminal of the lower terminals 2 is not less than that of the tongue portion 12.

In a third step, the metal shell 5 is formed by Metal Injection Molding. The contact module 10 is assembled to the metal shell 5 in the rear-to-front direction. The base portion 11 resists against the resisting portions 53. The mounting portions 111 are stuck in the locking grooves 511.

The sealer 7 is formed at a gap between the rear end of the insulative housing 1 and the metal shell 5 through the through hole 512. The upper fixing portion 71 is fixed to the top wall 510. The tuber 73 is mated with the through hole 512. The lateral fixing portions 72 are locked in the maintaining grooves 54 and flush with the lateral walls 513.

In other embodiments, the electrical connector 100 includes a metal shielding plate including a pair of fixing pins. The fixing pins extend downwardly from the two sides of the base portion 11 close to the mounting portions 111.

Figure 10:
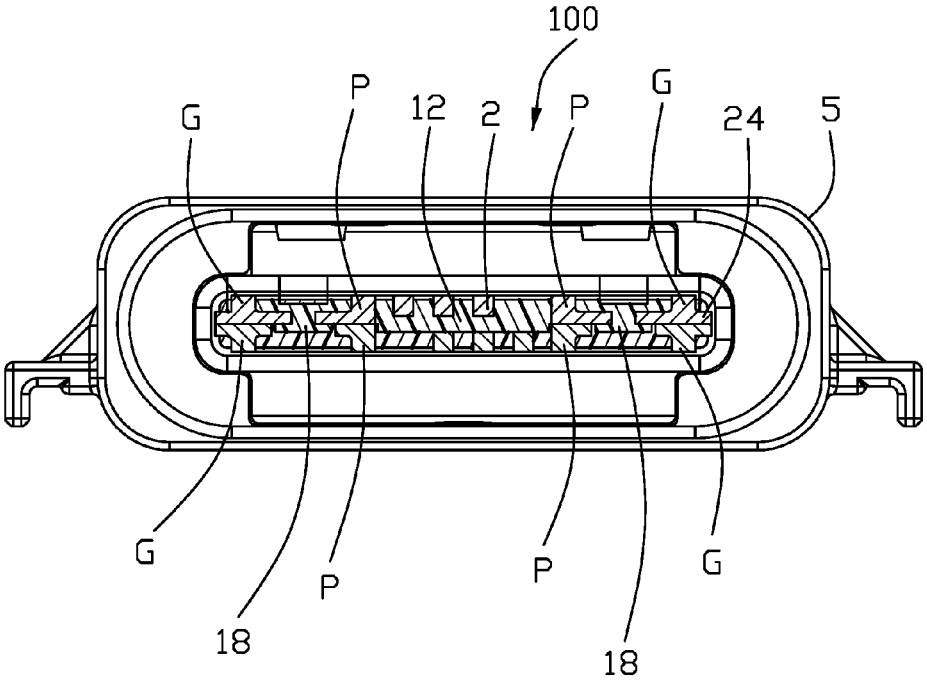
FIG. 10 is a cross-sectional view of the electrical connector taken along line 10-10 in FIG. 1.

When the contact module 10 is received in the metal shell 5, there is interference between the two. It prevents the metal shell 5 from falling off during the automatic production process and can be automatically produced by the terminal tape, which contributes to automatic production. Another feature of the invention is regarding the contact module 10. As mentioned before, the first insulator 1*a* is firstly integrally formed with the upper terminals via an insert-molding process wherein a plurality of dividers 17 are formed on the lower surface of the first insulator 1*a*, and successively the lower terminals are positioned upon the lower surface of the first insulator 1*a* and spaced from one another by the dividers 17, and finally the second insulator 1*b* is overmolded upon the first insulator 1*a* to form the complete contact module 10. In this embodiment, on one hand after the first stage insert-molding process, the first insulator 1*a* forms a retaining structure 18 having an I-shaped cross-section to simultaneously hold both the power terminal P and the grounding terminal G in position before the lower terminals and the second insulator 1*b* are applied thereon. On the other hand, different from the traditional Type C connector having the shielding plate separating the upper terminals and the lower terminals, in this embodiment, without any shielding plate between the upper terminals and the lower terminals, the upper grounding terminal G and the lower grounding terminal G are stacked with each other and the upper power terminal P and the lower power terminal P are stacked with each other while the upper signal terminal S is separated from the lower signal terminal S by the insulator 1*a*. In brief, the whole structure is simple and it is easily made. As shown in FIG. 10, the cross-section of the lower grounding terminal G is smaller than that of the upper grounding terminal G It is because the upper grounding terminal G is required to be held by the retaining structure 18. It is also noted that the upper grounding terminal P and the lower grounding terminal P cooperate with each other to form a locking notch on a lateral side of the tongue portion in place of that formed in the shielding plate of the traditional Type connector for engagement with a latch of the complementary plug connector.

While a preferred embodiment in accordance with the present disclosure has been shown and described, equivalent modifications and changes known to persons skilled in the art according to the spirit of the present disclosure are considered within the scope of the present disclosure as described in the appended claims.

What is claimed is:

1. An electrical connector comprising:

a contact module comprising an insulative housing having a base portion and a tongue portion, and a plurality of conductive terminals affixed to the insulative housing and each comprising a contacting portion exposed to a surface of the tongue portion, a soldering portion and a connecting portion connecting the contacting portion and the soldering portion;

a metal shell comprising a pair of locking grooves depressed forwardly from a rear surface thereof;

wherein the insulative housing comprises a pair of mounting portions located at two lateral sides of a rear end thereof, the mounting portions are stuck in the locking grooves when the contact module is assembled to the metal shell along a rear-to-front direction, and a lower portion of each mounting portion is resisted against the rear surface of the metal shell; and a sealer having a pair of lateral fixing portions and an upper fixing portion located between the lateral fixing portions, wherein the metal shell comprises a top wall, a pair of lateral walls, and a maintaining groove located behind the lateral walls and communicating with the locking groove, the upper fixing portion is maintained in the top wall, and the lateral fixing portions are maintained in the maintaining groove and flush with the lateral walls.

2. The electrical connector as claimed in claim 1, wherein the metal shell is formed by metal injection molding (MIM).

3. The electrical connector as claimed in claim 1, wherein the insulative housing comprises a first insulator affixing with the conductive terminals and a second insulator overmolded with the first insulator, and the mounting portions are located at two lateral sides of the second insulator.

4. The electrical connector as claimed in claim 1, wherein the locking groove penetrates a rear edge of the metal shell and the mounting portion is L-shaped.

5. The electrical connector as claimed in claim 1, wherein the metal shell comprises a through hole at an upper surface of the top wall, and the sealer fills a gap between a rear end of the insulative housing and the metal shell by way of the though hole.

6. The electrical connector as claimed in claim 5, further comprising a metal shielding plate, and wherein the conductive terminals are arranged in two rows, the metal shielding plate is sandwiched between the two rows of conductive terminals and has a pair of fixing pins, and the fixing pins are positioned in the base portion near the mounting portion.

7. An electrical connector comprising:

a contact module enclosed in a metallic shell, said contact module including:

an insulative housing having a base portion and a tongue portion forwardly extending from the base portion in a front-to-back direction, the tongue portion forming two opposite first and second surfaces in a vertical direction perpendicular to said front-to-back direction, said insulative housing having an inner insulator and an outer insulator via different molding processes to commonly form said base portion and said tongue portion;

a plurality of first terminals arranged in a first row along a transverse direction perpendicular to both said front-to-back direction and said vertical direction, and a plurality of second terminals arranged along the transverse direction in a second row which is spaced from the first row in said vertical direction, each of the first terminals including a first contacting portion exposed upon the first surface and a first soldering portion exposed outside of the housing, each of the second terminals including a second contacting portion exposed upon the second surface and a second soldering portion exposed outside of the housing; wherein the first terminals are firstly integrally formed with the inner insulator via an insert-molding process while the second terminals are successively positioned upon one surface of the inner insulator and commonly integrally formed with an outer insulator via another overmolding process so as to form the complete contact module; and the housing includes a pair of mounting portions on two sides in the transverse direction, and the metallic shell forms a pair of locking grooves to receive said mounting portions, respectively, for preventing relative movement of the housing in the vertical direction and a forward direction; and a sealer covering said pair of mounting portions and the locking grooves.

8. The electrical connector as claimed in claim 7, wherein the first terminals include at least a first power terminal, a first signal terminal and a first grounding terminal, and the second terminals include at least a second power terminal, a second signal terminal, and a second grounding terminal, the first power terminal and the second power terminal being stacked with each other in the vertical direction, the first grounding terminal and the second grounding terminal being stacked with each other in the vertical direction while the first signal terminal and the second signal terminal being spaced from each other via the inner insulator in the vertical direction.

9. The electrical connector as claimed in claim 8, wherein the inner insulator includes a retaining structure with an I-shaped cross-section not only separating the first power terminal and the first grounding terminal from each other but also holding both of said first power terminal and said first grounding terminal in position.

10. The electrical connector as claimed in claim 8, wherein the stacked first grounding terminal and second grounding terminal commonly form a locking notch on a lateral side of the tongue portion.

11. The electrical connector as claimed in claim 7, wherein front ends of both the first terminals and the second terminals extend forwardly beyond the inner insulator while protectively embedded in the outer insulator.

12. The electrical connector as claimed in claim 7, wherein said inner insulator forms a plurality of dividers to separate the corresponding second terminals in the transverse direction.

13. An electrical connector comprising:

a contact module enclosed in a metallic shell, said contact module including:

an insulative housing having a base portion and a tongue portion forwardly extending from the base portion in a front-to-back direction, the tongue portion forming two opposite first and second surfaces in a vertical direction perpendicular to said front-to-back direction, said insulative housing having an inner insulator and an outer insulator via different molding processes to commonly form said base portion and said tongue portion;

a plurality of first terminals arranged in a first row along a transverse direction perpendicular to both said front-to-back direction and said vertical direction, and a plurality of second terminals arranged along the transverse direction in a second row which is spaced from the first row in said vertical direction, each of the first terminals including a first contacting portion exposed upon the first surface and a first soldering portion exposed outside of the housing, each of the second terminals including a second contacting portion exposed upon the second surface and a second soldering portion exposed outside of the housing; wherein the first terminals include at least a first power terminal, a first signal terminal and a first grounding terminal, and the second terminals include at least a second power terminal, a second signal terminal and a second grounding terminal, the first power terminal and the second power terminal being stacked with each other in the vertical direction, the first grounding terminal and the second grounding terminal being stacked with each other in the vertical direction while the first signal terminal and the second signal terminal being spaced from each other via the inner insulator in the vertical direction; and the stacked first grounding terminal and second grounding terminal commonly form a locking notch on a lateral side of the tongue portion.

14. The electrical connector as claimed in claim 13, wherein said housing includes a pair of mounting portions on two sides in the transverse direction, and the metallic shell forms a pair of locking grooves to receive said mounting portions, respectively, for preventing relative movement of the housing in the vertical direction and a forward direction.

15. The electrical connector as claimed in claim 13, wherein a cross-section of the contacting portion of the first grounding terminal is larger than that of the second grounding terminal.

16. The electrical connector as claimed in claim 13, wherein the first terminals are firstly integrally formed with the inner insulator via an insert-molding process and then the second terminals are positioned upon one surface of the inner insulator and commonly integrally formed with an outer insulator via an over-molding process so as to form the contact module.

* * * * *